United States Patent [19]

Mizuno et al.

[11] Patent Number: 4,760,402

[45] Date of Patent: Jul. 26, 1988

[54] ANTENNA SYSTEM INCORPORATED IN THE AIR SPOILER OF AN AUTOMOBILE

[75] Inventors: Hiroshi Mizuno; Takashi Sakurai, both of Nagoya; Yoshihisa Shibata, Kariya, all of Japan

[73] Assignee: Nippondenso Co., Ltd., Kariya, Japan

[21] Appl. No.: 868,679

[22] Filed: May 30, 1986

[30] Foreign Application Priority Data

May 30, 1985 [JP] Japan ..... 60-115204

[51] Int. Cl.[4] ..... H01Q 1/32; H01Q 3/32

[52] U.S. Cl. ..... 343/713; 343/712; 343/758; 343/763

[58] Field of Search ..... 343/711, 712, 713, 757, 343/758, 763, 869, 705, 714, 715, 705

[56] References Cited

U.S. PATENT DOCUMENTS 3,972,045 7/1976 Perret ..... 343/705

3,984,837 10/1976 Tatnall ..... 343/705

4,450,451 5/1984 La Torre et al. ..... 343/705

*Primary Examiner*—William L. Sikes

*Assistant Examiner*—D. Johnson

*Attorney, Agent, or Firm*—Cushman, Darby & Cushman

[57] ABSTRACT

An antenna system for use in an automotive vehicle comprises a housing mounted on a body of the automotive vehicle and having at least a portion of an upper surface thereof made of a dielectric material which transmits radio waves, at least one planar antenna disposed rotatably within the housing to receive radio waves transmitted through the portion of the upper surface of the housing made of the dielectric material, and driving means for driving the planar antenna to effect scanning of a radio wave receiving direction to search for the radio wave receiving direction of higher sensitivity. The housing protects the antenna system and maintains the fine appearance of the automotive vehicle. Further, the housing has a shape like that of an air spoiler, which makes it possible to maintain the satisfactory aerodynamic characteristic of the automotive vehicle.

9 Claims, 2 Drawing Sheets

ANTENNA SYSTEM INCORPORATED IN THE AIR SPOILER OF AN AUTOMOBILE

BACKGROUND OF THE INVENTION

1. Field of the Invention

This invention relates to an antenna system for use in an automotive vehicle employing a planar antenna.

2. Description of the Related Art

Generally, it is desired that an antenna for use in an automotive vehicle is mounted on the vehicle body so that it does not project outside the body of the automotive vehicle in view of the factors such as the aerodynamic characteristic, the appearance of the vehicle, and the convenience of washing the vehicle body, etc. Thus, it has been proposed in the past to mount a planar antenna on the vehicle body, since the use of a planar antenna is advantageous especially in respect of the aerodynamic characteristic.

Recently, it has been desired to set up a mobile station for receiving radio waves transmitted from a satellite by using an antenna system mounted on an automotive vehicle or a ship, etc. It is necessary for the antenna system mounted on the mobile station to continuously track the satellite at all times. As an antenna system for use in a ship, the Cassegrain antenna system is proposed in which two axes, which make azimuth and elevation angles, respectively, are driven and which operates to detect deviations of the antenna beam by the conical scanning system thereby to drive the two axes, whereby automatic tracking is effected to have the antenna beam always pointed at the satellite (Published in the Journal of Japanese Electronic Communication Society, October, 1984).

When mounting a planar antenna on the vehicle body, it is necessary to cover the planar antenna with a radome in order to protect the antenna from wind and/or rain in bad weather, or from water at the time of car washing. In this case, it becomes necessary for the radome to satisfy the requirements of the aerodynamic characteristic, the appearance of the vehicle body, etc. Further, when the planar antenna mounted on the vehicle body is rotated within a plane, in which the planar antenna is placed when it has been installed, in order to effect the adjustment of an azimuth angle of the antenna beam, there occurs a problem of selecting a suitable place of installation of a driving device required to rotate the antenna.

In addition, when receiving radio waves from a satellite by an antenna system mounted on an automotive vehicle, the use of a conventional antenna system for a ship as an antenna system for an automotive vehicle is substantially impossible in view of the aerodynamic characteristic, external appearance, etc. of the vehicle, since a conventional antenna system for a ship generally has great size and heavy weight.

SUMMARY OF THE INVENTION

It is an object of the present invention to provide an automobile antenna system comprising at least one planar antenna which overcomes the above-mentioned problems of a radome and which is capable of receiving radio waves from a satellite.

The antenna system of this invention comprises a housing having at least a portion of its upper surface formed of a dielectric material, which allows radio waves to pass through, and mounted on the body of an automotive vehicle, a single planar antenna or plural planar antennas accommodated in the housing so that the principal surface of each planar antenna for receiving radio waves faces the upper surface portion of the housing formed of a dielectric material and is substantially parallel to the body of the vehicle, and driving means for causing each planar antenna to effect scanning of the radio wave receiving directions of each planar antenna within the housing, thereby determining the radio wave receiving direction of higher sensitivity. It is possible to make the housing have an external shape like that of a so-called air spoiler, for example, that is a member which is mounted on a vehicle body and rectifies the air stream along the vehicle body, when the vehicle is running, thereby being effective in improving the stability of the vehicle when it is running at a high speed. By virtue of this structure, it is possible to arrange the planar antenna and the housing acting as a radome for the planar antenna without deteriorating the aerodynamic characteristic and the appearance of the vehicle and besides to accommodate the driving means suitably within the housing. Further, since it is possible to increase the breadth of the directivity pattern in the direction of elevation of the antenna system by making the plural planar antennas of the antenna system have respective different directivity in the direction of elevation and by causing the planar antennas to effect scanning in the same direction and phase by means of the driving means, it becomes possible to do without a tracking mechanism operating in the direction of elevation, when receiving radio waves transmitted from a satellite on an automotive vehicle, and hence to attain the reception of radio waves from a satellite by using an antenna system of the simple structure.

DESCRIPTION OF THE PREFERRED EMBODIMENTS

The embodiments of the present invention will be described in detail with reference to the accompanying drawings.

Figure 1:
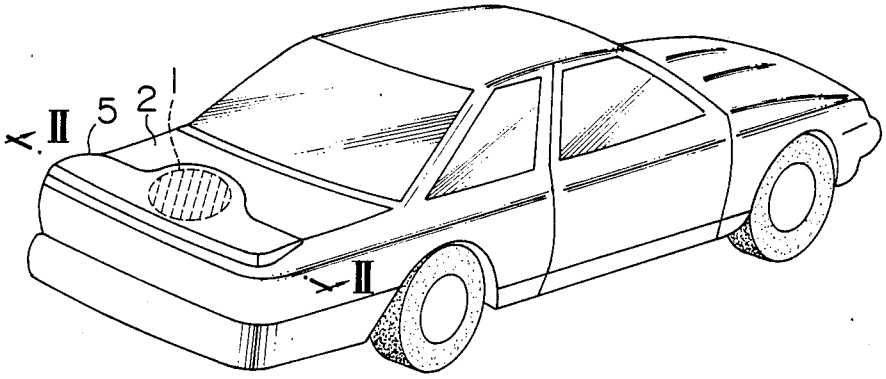
FIG. 1 is a perspective view showing the external appearance of the antenna system of a first embodyment of the present invention.
Figure 2:
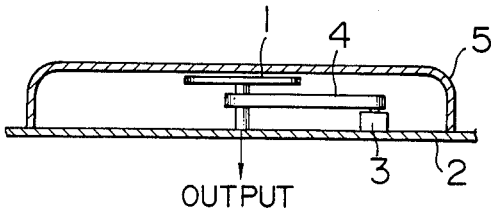
FIG. 2 is a longitudinal sectional view of an essential portion of the antenna system shown in FIG. 1 taken along the line II—II in FIG. 1.

FIGS. 1 and 2 show the structure of a first embodiment of the present invention. In FIGS. 1 and 2, numeral 1 designates a planar antenna having a circular shape which is arranged on a trunk lid 2 of an automotive vehicle in such a manner that its principal radio wave receiving surface is arranged substantially horizontally (parallel to the vehicle's surface) and which is rotatably mounted on a shaft at its central portion. The planar antenna 1 is a planar antenna including a microstrip array antenna having antenna elements composed of an array of microstrip lines formed by etching a printed-circuit board, a waveguide slot array antenna having an array of slots formed in the wall of a waveguide, etc. Since, the planar antenna 1 is designed to rotate within a plane of installation thereof in this embodiment, the planar antenna 1 has a circular shape for the purpose of utilizing the antenna area effectively, though there is no limitation on its external shape. Numeral 3 designates a motor mounted on the trunk lid 2 to rotate the planar antenna 1, and numeral 4 designates a belt for transmitting a turning force of the motor 3 to the planar antenne 1. Numeral 5 designates an air spoiler acting as a housing which is mounted on the trunk lid 2 of the vehicle to cover the planar antenna 1, the motor 3 and the belt 4 and has a shape suitable to rectify the air stream along the vehicle body when the vehicle is running. A portion or the whole of the upper surface of the air spoiler 5 is made of a dielectric material such as FRP, etc. which transmits radio waves.

In the above-mentioned structure of the antenna system of this embodiment, the planar antenna 1 is rotated by the motor 3 through the belt 4, whereby the main beam of the planar antenna 1 can be directed in any desired direction in which the desired radio waves are received by the planar antenna 1 or the planar antenna 1 is intended to transmit radio waves. Here, since the planar antenna 1 and the driving means including the motor 3, etc. for rotating the former are accommodated within the air spoiler 5 partly or wholly made of a dielectric material which transmits radio waves, the planar antenna 1, etc. accommodated within the air spoiler 5 are not exposed to wind and/or water when the automotive vehicle is running in bad weather or while it is washed, and further there is no need to give any particular consideration to a place where the driving means including the motor 3, etc. should be arranged. While the shape of the air spoiler 5 has to be determined in consideration of the size of the planar antenna 1, since the planar antenna 1 is small in thickness, the air spoiler 5 has no big difference in the shape as compared with a conventional air spoiler and there is no great influence on the essential function of an air spoiler to rectify the air stream along the vehicle body. Thus, aerodynamic characteristic and the appearance of the automotive vehicle are not deteriorated by the provision of the air spoiler 5. Further, the antenna system of this embodiment is advantageous in that the planar antenna 1, the motor 3 and the air spoiler 5 can be mounted on the vehicle body by applying simple working such as punching, etc. to the vehicle body and therefore the antenna system of this embodiment can be mounted easily on the vehicle body without making any great alteration in the existing automotive vehicles.

Figure 3:
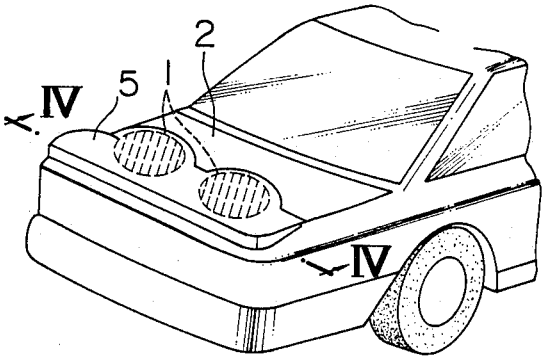
FIG. 3 is a perspective view showing the external appearance of the antenna system of a second embodiment of the present invention.
Figure 4:
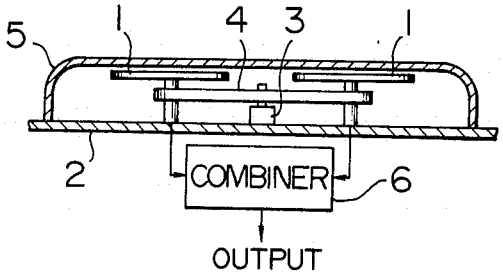
FIG. 4 is a longitudinal sectional view of an essential portion of the antenna system shown in FIG. 3 taken along the line IV—IV in FIG. 3.

Referring to FIGS. 3 and 4, the Figures. illustrate the structure of the antenna system of a second embodiment of this invention, and the component parts therein having the same functions as those shown in FIGS. 1 and 2 are designated by the same reference numerals. The antenna system of this embodiment includes two planar antennas 1. As shown in FIG. 4, both planar antennas 1 are arranged in the same plane (horizontal plane) in such a mannner that the main beams of the respective planar antennas 1 are directed in the same direction, and the turning force of a motor 3 is transmitted to each of the planar antennas 1 through a belt 4 as in the first embodiment, whereby both planar antennas 1 are rotated simultaneously in the same direction through the same angle. The outputs of the respective planar antennas 1 are supplied to a combiner 6 disposed inside the vehicle body where both outputs are matched to be in phase and added together to be taken out therefrom as an output of the antenna system.

In the above-described structure of the antenna system of the second embodiment of this invention, if the total sum area of the two planar antennas 1 is selected to be equal to the area of the planar antenna of the first embodiment, the diameter of each of the planar antennas of the second embodiment is reduced to $1/\sqrt{2}$ of that of the planar antenna of the first embodiment. As a result, it becomes possible to make effectual use of the space on the trunk lid 2 and to increase the degree of freedom of the selection of the shape of the air spoiler 5.

Figure 5:
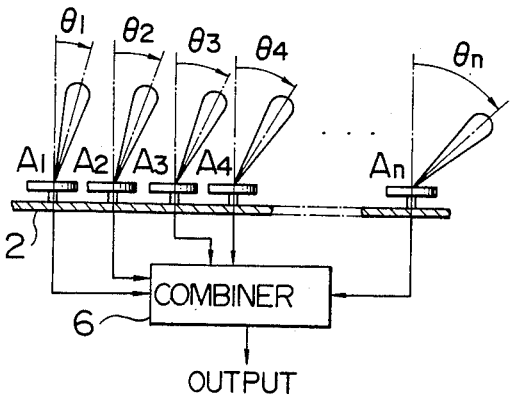
FIG. 5 is an explanatory diagram for explaining the operation of a third embodiment of the present invention.

Next, with reference to FIG. 5 an explanation will be made of an antenna system of a third embodiment of this invention which comprises n antennas (where n is an integer equal to 2 or more) having respective main beams which differ in the elevation angle from each other. In this embodiment, as illustrated in FIG. 5, n planar antennas $A_1, A_2, \ldots, A_n$ having respective main beam elevation angles $\theta_1, \theta_2, \ldots, \theta_n$ are disposed to be rotatable in the same plane on a trunk lid 2 of an automotive vehicle so that the respective main beams of the planar antennas $A_1$ to $A_n$ are in the same azimuth direction and are rotated by the same motor. The outputs of the respective planar antennas $A_1$ to $A_n$ are supplied to a combiner 6 where they are matched to be in phase and are then added together to produce an output of the antenna system. In the illustration of FIG. 5, the antenna driving means for the respective planar antennas $A_1$ to $A_n$ including the motor, etc. and the air spoiler are omitted for the purpose of simplification.

In the structure of the antenna system of this embodiment, the n planar antennas $A_1$ to $A_n$ may be arranged so that the lobes of the respective main beams of the planar antennas $A_1$ to $A_n$ are positioned sequentially in the direction of elevation and thus the breadth of the resultant directivity in the direction of elevation of the antenna system as a whole is increased by n times that of an antenna system employing a single antenna. When it is required to effect high precision tracking of a fixed direction of radio wave transmission, in which radio waves transmitted from a satellite are received on an automotive vehicle, for example, a correction angle for the direction of elevation of the antenna beam, which is necessitated by the tilting movement of the running automotive vehicle, is approximately $\pm 10°$. Thus, the adjustment of the elevation angle of the antenna beam can be eliminated by the suitable selection of the number n of the antennas to be used, and hence it becomes possible to receive radio waves transmitted from a broadcasting satellite with high sensitivity by tracking the broadcasting satellite solely by the adjustment of the azimuth angle of the antenna beams. Further, in this embodiment, it is also possible to use n independent planar antennas $A_1, A_2, \ldots, A_n$ and to select and use one of the n planar antennas which can receive radio waves with highest sensitivity.

While, in the above-described embodiments, the housing has an external shape like that of an air spoiler, the housing may have any other shape so far as the aerodynamic characteristic and the appearance of the vehicle are not deteriorated.

Further, while, in the above-described embodiments, the planar antenna or antennas and the driving means therefor are directly mounted on the trunk lid, the planar antenna or antennas and the driving means may be combined to form a single unit so that the unit may be installed within the air spoiler.

What is claimed is:

1. An antenna system for an automotive vehicle comprising:

air spoiler means mounted on a body of said automotive vehicle for rectifying an airstream along the body of said automotive vehicle, said air spoiler having an interior space and having at least a portion of an upper surface thereof made of a dielectric material for transmitting radio waves;

at least one planar antenna element accommodated within said interior space of said air spoiler arranged on the body of an automotive vehicle so that a principal radio wave receiving plane of said planar antenna is substantially parallel with a surface of the body and faces said portion of the upper surface of said air spoiler made of the dielectric material, said planar antenna element being supported to be rotated about a substantially vertical axis; and driving means accommodated within said interior space of said air spoiler for rotating said planar antenna.

2. An antenna system according to claim 1, wherein said air spoiler is mounted on a trunk lid of said automotive vehicle.

3. An antenna system according to claim 1, wherein said planar antenna element comprises a microstrip antenna element.

4. An antenna system according to claim 1 wherein the principal radio wave receiving plane of said planar antenna element has a circular shape.

5. An antenna system according to claim 1, further comprising additional antenna elements so that the system comprises a plurality of planar antenna elements and wherein respective main beams of said plurality of planar antenna elements differ in elevation angle from each other so as to enlarge the breadth of directivety in the direction of elevation of the antenna system.

6. An antenna system according to claim 1, further comprising additional antenna elements so that the system comprises a plurality of antenna elements and further comprising a combiner to which respective outputs of said planar antenna elements are coupled, which matches said outputs of said planar antenna elements to be in phase and then adds the same together, thereby producing an output of said antenna system.

7. An antenna system according to claim 1, further comprising additional antenna elements so that said system comprises a plurality of planar antenna elements and wherein said driving means drives said plurality of planar antenna elements so that respective main beams of said plurality of planar antennas are in the same azimuth direction.

8. An antenna system according to claim 1, further comprising additional antenna elements so that the system comprises a plurality of planar antenna elements and wherein said plurality of planar antenna elements which are rotated simultaneously by one and the same driving means.

9. An antenna system according to claim 1, wherein said planar antenna element comprises a waveguide slot array antenna.

* * * * *